United States Patent [19]

Pecoraro

[11] 3,977,584

[45] Aug. 31, 1976

[54] BODY HARNESS FOR THE PROTECTIVE RETENTION OF AN EXTENSION CORD

[76] Inventor: John F. Pecoraro, 406 Gregory Road, Paramus, N.J. 07652

[22] Filed: June 9, 1975

[21] Appl. No.: 585,446

Related U.S. Application Data

[63] Continuation-in-part of Ser. No. 458,487, April 5, 1974, abandoned.

[52] U.S. Cl. ..... 224/5 H; 224/5 R; 224/26 B

[51] Int. Cl.[2] ..... A45C 1/04

[58] Field of Search ..... 224/5 P, 5 V, 5 BC, 224/5 W, 5 H, 5 A, 5 R, 26 R, 26 B

[56] References Cited

UNITED STATES PATENTS

| | | | |
|---|---|---|---|
| 1,164,928 | 12/1915 | Corcoran | 224/5 B |
| 2,676,738 | 4/1954 | Herrick | 224/5 H |
| 2,714,979 | 8/1955 | McCarthy | 224/5 P |
| 2,990,089 | 6/1961 | Nystrom | 224/5 V |
| 3,258,788 | 7/1966 | Anciaux | 224/5 BC |

*Primary Examiner*—L. J. Paperner
*Assistant Examiner*—Lawrence J. Oresky
*Attorney, Agent, or Firm*—Ralph R. Roberts

[57] ABSTRACT

In this invention a body harness of elasticized cord is provided and is adapted to retain an extension cord such as is used to supply electric energy from a source to a power tool which may be held and used by the one on which the harness is mounted. This harness includes two substantially equal sized loops which are secured to each other at one point and preferably at another point a short distance from the first point. This secured portion retains the ends of the material forming the loops and in use positions the harness at the midportion of the user's back. A snap or clasp is carried by one of the loops with this portion having means for releasably retaining a forward portion of the extension cord. This snap also releasably engaging and retaining a suitable companion portion of the snap slidably secured to the other loop.

7 Claims, 4 Drawing Figures

BODY HARNESS FOR THE PROTECTIVE RETENTION OF AN EXTENSION CORD

Cross Reference to Related Applications

This application is a Continuation-in-Part application of U.S. Patent application Ser. No. 458,487, filed Apr. 5th, 1974 and entitled PLASTIC BODY LOOP, now abandoned.

BACKGROUND OF THE INVENTION

1. Field of the Invention

With reference to the classification of art as established in the U.S. Patent Office the present invention pertains to the general Class entitled, "Package and Article Carriers" (Class 224) and in particular the subclass entitled, "body and attached body harness" (subclass 5BC) and also the subclass entitled, "electrical or medical devices" (subclass 5H).

2. Description of the Prior Art

Body supports and harnesses for carrying knapsacks, flags, binoculars and similar devices are well known and are shown in many patents. Patents directed toward the arrangement and placement of electric extension cords which may be moved with the body of the user while maintaining the cord in an out of the way manner is shown in the U.S. Pat. No. 1,164,928 to CORCORAN as issued on Dec. 21st, 1915. This patent pertains to an arm band for carrying the cord used with an electric iron. A shoulder supported grip for a welding line is shown in U.S. Pat. No. 2,714,979 as issued to MCCARTHY on Apr. 9th, 1955. These and similarly shown devices are rather cumbersome and do not free the arms of the user in a manner desirable in the use of electric hedge trimmers, cutters, power saws and like devices which because of the point of use require long extension cords. In the present invention a harness made of a selected length of elasticized cord is secured at its ends and midlength to form two loops. A short distance from this joining of the cord is an additional securing of the two loops of the cord to form a short yoke portion. This yoke portion is contemplated to be placed at the midback of a user. Through the loop forming the yoke and between the two cords may be passed the extension cord to be carried by the user. While and when the harness is in mounted condition, the front portions on these loops have slidably mounted thereon cooperative portions of a snap. This may be a wire form slidably retained on one of the loops by a ring-like member and on the other loop may be a button-like receiving device which is also slidably retained by a wire ring. The retaining form on one of the loops engages and retains the securing end of the other device on the other loop to secure the two loops in a buckled or latched condition. The forward end of the extension cord is passed through retaining means in this clasp or clip to maintain the extension cord in a desired central location at the front of the user.

SUMMARY OF THE INVENTION

The harness of this invention is preferably made from one length of elasticized rope or cord and fastened at the ends. At this fastening point the midportion of the cord is also secured to form two loops. These loops provide the shoulder strap portions of the harness. Assistance in placing and maintaining this harness midway of the back of the user is the additional clamping of the loops to form a short yoke. This yoke is normally positioned at the back of the user and forms the back portion of the harness. The front of the harness is drawn together after placing the two loops on the shoulders of the user. One of the arms is passed through one loop and the other arm is passed through the other loop. The front loop portions are now drawn together and by means of a snap, clip or buckle are secured in place. The forward portion of the electric extension cord is brought through an enlarged portion of this buckle, snap or clip so as to removably retain the forward portion of the extension cord during the time the snap is closed to hold the harness in place.

In addition to the above summary the following disclosure is detailed to insure adequacy and aid in understanding of the invention. This disclosure is not intended to cover variations in form or additions of further improvements. For this reason there has been chosen a specific embodiment of the body harness as adopted for mounting on a user and showing a preferred means for retaining an extension cord by said harness. This specific embodiment has been chosen for the purposes of illustration and description as shown in the accompanying drawing wherein:

BRIEF DESCRIPTION OF THE DRAWING

In the following description and in the claims various details are identified by specific names which are intended to be generic in their application. Corresponding reference characters refer to like portions of the harness throughout the four figures of the drawing.

This drawing and specification disclose the preferred details of construction but it should be understood that these details may be modified and incorporated in other structural forms than shown.

DESCRIPTION OF THE PREFERRED EMBODIMENT

Figure 3:
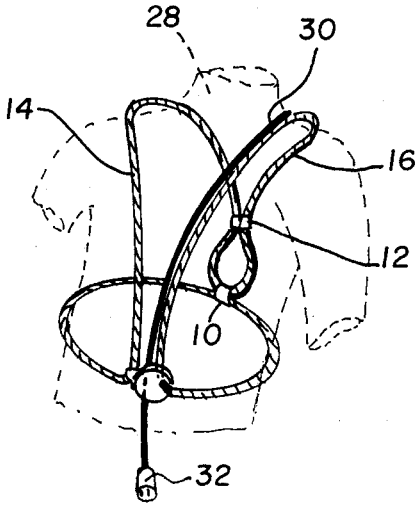
FIG. 3 represents a diagrammatic view of the harness arrangement of FIG. 2 and showing the front view of the harness placed upon the user and with the snap closed to retain the harness loops and the forward end of an extension cord adjacent the body of the user.
Figure 2:
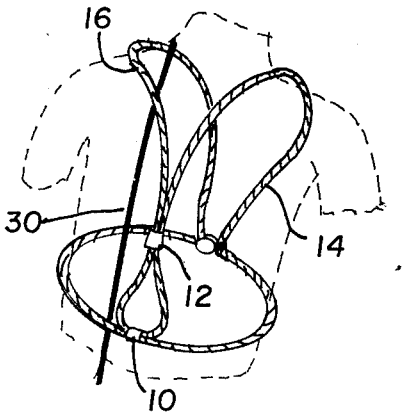
FIG. 2 represents the harness of FIG. 1 in a diagrammatic back view and symbolically looking at the back of the user with the harness arranged in position on the body of the user which is indicated by phantom outline.
Figure 1:
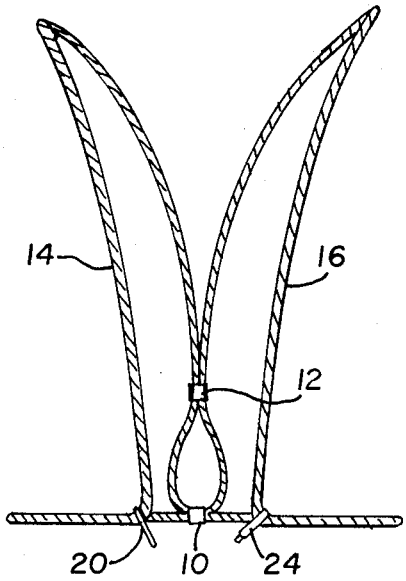
FIG. 1 represents a front view of the harness of this invention which is more-or-less symbolically in place but with the snap or clip retaining means used to secure the front of the loops in an open condition.
Figure 4:
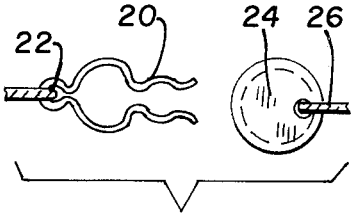
FIG. 4 shows in an enlarged view an inexpensive wire form, snap, clip or latch which may be used to retain the front loops in position while at the same time providing a guide and retaining means for the extension cord.

As seen in the drawing, one embodiment of the harness is shown although minor modifications can be made without altering the use and utility of the body harness. As reduced to practice, a length of elasticized cord may be approximately one-eighth to one-quarter inch in thickness and about or slightly more than 4 feet long. This length is fastened at its ends by a clip 10. In addition to these ends a midportion of the elasticized cord is also secured at this point resulting in the forming of two loops of substantially equal extents. A short distance from this joining of the ends and loops by the clip 10 like side portions of the two loops are secured to each other by means of an additional clip 12. This additional clip performs two purposes. It forms a short yoke for fitting in the small of the back of the user and provides a loop through which or by which the extension cord, to be later identified, may be passed or retained as the cord is led to the back of the user. Extending from clips 10 and 12 are loops 14 and 16 of substantially equal size. Slidably carried on one of these loops is a clip or snap which as shown is a wire form 20. This member 20 is slidably retained on a loop by means of ring-like retainer 22. On the other loop there is provided a clasp retained member 24 which is slidably retained on this loop by means of another ring-like retainer. Retainers 26 may be wire rings and provide means so that the user may slidably adjust the position of the secured snap to accommodate the body contour, clothing, etc. and adjust the up and down position to where he or she wishes the extension cord to be positioned at the front. This harness, in FIGS. 2 and 3, is indicated as mounted on the user's body which is shown in phantom outline. Loops 14 and 16 are placed over the shoulders and underneath the arms of the user. Prior to placing the harness in this position or after placing the harness in this position the foreportion of extension cord 30 is placed over one of the shoulders with a short portion extending down the front of the user's body. One of the over shoulder loops retains the extension cord adjacent the body and with this cord free to extend rearwardly. Through the enlarged portion of the wire clip 20 is placed the extendion cord. Usually the cord is positioned with the connecting socket 32 brought rather close to the clip or wire form 20 but this position will depend upon the extending amount of cord available in the electrical U-shaped implement being used. The latch piece 24 is slipped into the opening between the ends of the spring prongs of the clip. With the loops drawn snugly into position against the lower portion of the body a belt-like configuration is snugly secured around the waist. The remaining over the shoulder portion of the loops provide the shoulder straps snugly drawn to the body of the user. In this arrangement the socket 32 of the extension cord is positioned adjacent or near the stomach of the user. Plugging of the appliance into the socket of the connector of the electric appliance to be used is easily accomplished with the 4 or less feet of extension cord usually furhished with the appliance.

If desired, the extension cord may be brought through the loops formed between the clamp clips 10 and 12 at the rear of the harness which is then brought over the shoulder and through the clip 20 which is used to maintain the two loops in a drawn together condition. An inexpensive wire-type clip 20 and mating plug 24 is shown and although this type of connector is commonly used, key holders or other snap-type latches or clips may be used with this harness as long as an entryway and closable passageway is provided. Means for the removable retention of the end of the extension cord is desired with the latch means used to draw and retain the front of the loops together. It is also contemplated that an additional securing clip whereby the extension cord may be securely fastened to a portion of a front loop may also be provided if such an attachment is desired or needed.

As a method the present invention discloses a method of assembly and use of a body harness which is easily placed and secured to the body of a user and in mounted condition is positioned over the arms and upper body portion of said user providing a guide and retaining means for an extension cord and the like, said method including the steps of forming and arranging a pair of substantially like sized loops of stretchable material and attaching these loops to each other at one portion, this attached portion disposed to be placed a the mid-back of the user on which the harness is to be mounted; providing a snap and slidably securing this snap to one of the loops, said snap, selectively closable and when closed having a provision for retaining a selected portion of the extension cord, and providing a complementary snap securing means and mounting this securing means on the other loop, the snap engaging and retaining this complementary means so that when the lower portion of the loops are drawn toward each other there is formed a belt-like encirclement of the user's waist and when the snap in cooperation with the complementary means is closed a retaining of the forward portion of the extension cord is provided and at this same time the mounted harness has a placing of one loop over one shoulder with the belt-like portion of this loop passing under the arm, and also the placing of the other loop over the other shoulder and bringing the belt-like portion of said other loop under the arm and tightening and positioning the harness tightly to the body of the user with the overlaid body harness at the user's back retaining a forward portion of the cord between the harness and the user's body with the cord then passing over the shoulder and to the retaining means provided with and by the closed snap.

Terms such as "up", "down", "bottom", "top", "front", "back", "in", "out" and the like are applicable to the harness shown and described in conjunction with the drawing. These terms are merely for the purpose of description and do not necessarily apply to the position in which the harness may be constructed or used.

It is to be understood modifications may be made within the scope of the accompanying claims and protection is sought to the broadest extent the prior art allows.

What is claimed is:

1. A body harness which is easily placed and secured to the body of a user and in mounted condition is positioned over the arms and upper body portion of said user to provide a guide and retaining means for an extension cord and the like, said harness including: (a) a pair of substantially like sized loops of stretchable material, these loops attached to each other at one portion, this attached portion disposed to be placed at the mid-back of the user on which it is to be in mounted condition; (b) a snap securing member which is a substantially U-shaped wire form having a wider space between the wires of the legs of the U-shaped form opposite the opening of the U-shaped form slidably secured to one of the loops, said member selectively closable by a complementary means and when closed with provisions to retain a selected portion of the extension cord in said wider space, and (c) complementary snap securing means which is a disc-like member having a wire retaining groove adapted to receive and retain the wire form, said means provided on and by the other loop, the snap securing member and this complementary means connectable when the lower portion of the loops are drawn toward each other to form a belt-like encirclement of the user's waist and when the snap securing member in cooperation with the complementary means is closed, means for retaining a forward portion of the extension cord is provided and at this same time the mounted harness has one loop brought over one shoulder with the belt-like portion of this loop passing under the arm, and also the other loop is brought over the other shoulder and the belt-like portion of said other loop is brought under the arm, this tightened and positioned harness being drawn tightly to the body of the user with the overlaid body harness at the user's back retaining a forward portion of the cord between the harness and the user's body with the cord then passing over the shoulder and to the retaining means provided with the snap securing member.

2. A body harness as in claim 1 in which the harness loops are made of elasticized cord.

3. A body harness as in claim 2 in which the cord is a single length which is connected at its ends and at this joining the midlength of the cord is also secured to form the two loops.

4. A body harness as in claim 3 in which two of the cords forming the loops are additionally secured together a short distance from their joining at the midpoint, this second joining forming with the midpoint joining a yoke portion which assists in maintaining the back portion of the harness in place on the body of the user.

5. A body harness as in claim 2 in which the cord is substantially round and of a diameter from one-eighth to three-eighths inch.

6. A body harness as in claim 1 in which the snap securing member is secured to one loop by a ring-like member slidable on the cord and the complementary snap securing means is secured to the other loop by a ring-like member slidable on this loop.

7. A method of assembly and use of a body harness which is easily placed and secured to the body of a user and in mounted condition is positioned over the arms and upper body portion of said user providing a guide and retaining means for an extension cord and the like, said method including the steps of: (a) forming and arranging a pair of substantially like sized loops of stretchable material and attaching these loops to each other at one portion, this attached portion disposed to be placed at the mid-back of the user on which the harness is to be mounted; (b) providing a snap and slidably securing this snap to one of the loops, said snap selectively closable and when closed having a provision for retaining a selected portion of the extension cord, and (c) providing a complementary snap securing means and mounting this securing means on the other loop, the snap engaging and retaining this complementary means so that when the lower portion of the loops are drawn toward each other there is formed a belt-like encirclement of the user's waist and when the snap in cooperation with the complementary means is closed a retaining of the forward portion of the extension is provided and at this same time the mounted harness has a placing of one loop over one shoulder with the belt-like portion of this loop passing under the arm, and also the placing of the other loop over the other shoulder and bringing the belt-like portion of said other loop under the arm and tightening and positioning the harness tightly to the body of the user with the overlaid body harness at the user's back retaining a forward portion of the cord between the harness and the user's body with the cord then passing over the shoulder and to the retaining means provided with and by the closed snap.

* * * * *